United States Patent [19]

Honda et al.

[11] Patent Number: 4,982,689

[45] Date of Patent: Jan. 8, 1991

[54] DEVELOPING APPARATUS HAVING A DEVELOPING ROLLER WITH FINE CONCAVITIES

[75] Inventors: Mitsuru Honda, Yokohama; Takahiro Kubo, Tokyo, both of Japan

[73] Assignee: Canon Kabushiki Kaisha, Tokyo, Japan

[21] Appl. No.: 358,568

[22] Filed: May 30, 1989

[30] Foreign Application Priority Data

May 30, 1988 [JP] Japan ..... 63-131950

[51] Int. Cl.[5] ..... G03G 15/08

[52] U.S. Cl. ..... 118/656; 118/657; 355/259; 355/251

[58] Field of Search ..... 118/657, 658, 661, 656; 355/251, 253, 259

[56] References Cited

U.S. PATENT DOCUMENTS

| | | | |
|---|---|---|---|
| 3,863,603 | 2/1975 | Buckley | 118/658 |
| 4,018,187 | 4/1977 | Abbott et al. | 118/658 |
| 4,136,637 | 1/1979 | Snelling | 118/658 |
| 4,292,387 | 9/1981 | Kanbe et al. | 430/102 |
| 4,377,332 | 3/1983 | Tamura | 355/3 |
| 4,380,966 | 4/1983 | Isaka et al. | 118/651 |
| 4,387,664 | 6/1983 | Hosono et al. | 118/658 |
| 4,395,476 | 7/1983 | Kanbe et al. | 430/102 |
| 4,646,677 | 3/1987 | Lounsbury | 118/658 |
| 4,786,936 | 11/1988 | Ikegawa | 118/657 |
| 4,870,461 | 9/1989 | Watanabe et al. | 355/251 |

*Primary Examiner*—R. L. Moses

*Attorney, Agent, or Firm*—Fitzpatrick, Cella, Harper & Scinto

[57] ABSTRACT

A developing apparatus for developing an electrostatic latent image includes a container for containing a developer, a rotatable developing roller for carrying the developer supplied from the developer container into a developing zone where the electrostatic latent image is developed, the developing roller having a developer carrying surface having fine concavities and finely smooth ironed surface portions.

9 Claims, 8 Drawing Sheets

DEVELOPING APPARATUS HAVING A DEVELOPING ROLLER WITH FINE CONCAVITIES

FIELD OF THE INVENTION AND RELATED ART

The present invention relates to an apparatus for developing an electrostatic latent image formed through an electrophotographic process or an electrostatic recording process or the like.

In an image forming apparatus or the like using the electrophotographic process, for example, a developing apparatus for developing into a visual image, the electrostatic latent image formed on an electrophotographic photosensitive member with a developer, is provided with a developing sleeve, which will hereinafter be called "sleeve", for carrying the latent image formed on the photosensitive member to a developing position. The sleeve is usually cylindrical. It is inevitable that the surface of the sleeve is finely roughened so as to allow the developer to be uniformly applied on the outer periphery, irrespective of the material of the developer, that is, whether the developer is a one component developer, a two component developer, a magnetic developer, or a non-magnetic developer, an insulating or dielectric developer.

As for the method of providing the roughened surface, there are (1) a sandpaper method (U.S. Pat. No. 4,377,332) wherein the sleeve surface is rubbed by sandpaper, (2) a sandblast method (U.S. Pat. No. 4,377,332) wherein the sleeve surface is treated with spherical particles, (3) another sandblast method (U.S. Pat. No. 4,380,966) wherein the sleeve surface is treated with non-spherical particles having sharp apices and (4) a combined method wherein the above methods (2) and (3) are combined (Japanese Laid-Open Patent Application No. 11974/1983). Those sleeves are advantageous that they can carry and convey a uniformly thin layer of the developer.

However, they involve the following problems. First, before the sleeve is rubbed by the sandpaper, or it is treated by the sandblasting, a sleeve abrading process is inevitable in order to provide sufficient physical accuracy of the outer diameter of the sleeve, with the result of increased manufacturing cost. In addition, the fine projections on the sleeve surface provided by the treatment with the sandblasting, are worn with long term use, and therefore, the surface conditions of the sleeve is different after long term use from that at the initial stage of use. The inventors' experiments and investigations have revealed that the change of the surface of the sleeve result in the change in the developer conveying force or the amount of triboelectric charge of the developer, for example, and therefore, the quality of the developed image changes.

Additional problems are that the developer is fused on the sleeve when a relatively soft developer capable of being fixed by pressure or being heat-fixed at low temperature is used, that the developer is fused on the sleeve when the developer is deteriorated, and that various inconveniences caused by the sleeve.

SUMMARY OF THE INVENTION

Accordingly, it is a principal object of the present invention to provide a developing apparatus which is capable of carrying and conveying a uniformly thin layer of the developer, and which has a developing roller with a confined deterioration of the developed image quality with long term use.

It is another object of the present invention to provide a developing apparatus having a developing roller width in which the developer fusing can be confined.

It is a further object of the present invention to provide a developing apparatus having a developing roller which can be produced with high production efficiency, which is better in quality and which is low in manufacturing cost.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
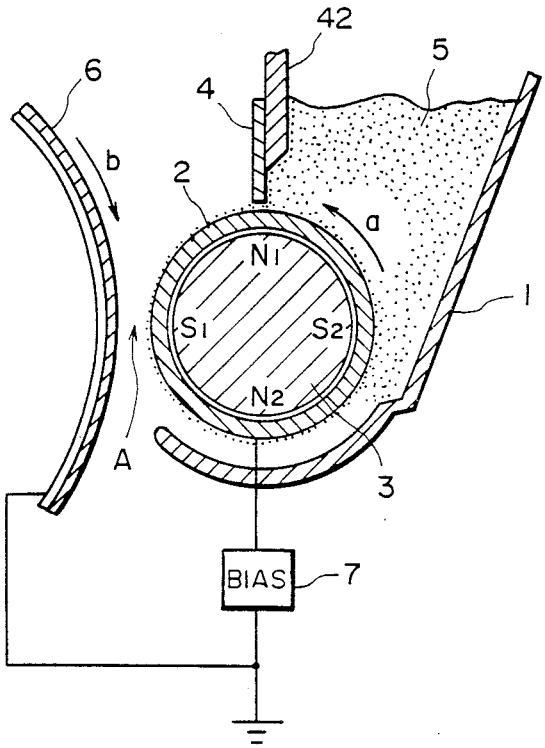
FIG. 1 is a sectional view of a developing apparatus according to an embodiment of the present invention.

Referring to FIG. 1, there is shown a developing apparatus according to an embodiment of the present invention, which comprises a developer container 1 containing a developer 5, a developing roller, that is, a sleeve 2 rotatably supported in the developer container 1, a fixed magnet roller 3 within the sleeve 2 and a developer regulating blade 4 disposed spaced from the sleeve 2 with a clearance.

The non-magnetic sleeve 2 rotates in a direction indicated by an arrow a to carry the developer, which will hereinafter be called "toner", in the developer container 1 from the developer container 1 to a developing position or zone A where the sleeve 2 is faced to a photosensitive drum 6 carrying an electrostatic latent image to be developed and rotating in a direction b. The toner is triboelectrically charged by the friction with the sleeve 2 to a polarity for developing the latent image. The toner on the sleeve 2 is regulated to a predetermined thickness by the regulating blade 4 and is then is conveyed to the developing zone A. In this embodiment, the toner 5 is magnetic toner. The blade 4 is made of a magnetic material such as iron or the like and is disposed in the influence of the magnetic field provided by a magnetic pole N1 of the magnet 3. The magnetic field, by the magnetic pole N1, is concentrated on the blade 4, by which a strong magnetic curtain is formed in the clearance between the sleeve 2 and the blade 4. By the cooperation between the toner confining force by the magnetic curtain and the toner conveying force by the sleeve 2, a magnetic toner layer having a thickness smaller than the clearance between the sleeve 2 and the blade 4 (U.S. Pat. No. 4,387,664) is formed. In this embodiment, the clearance between the blade 4 and the sleeve 2 is determined so that the thickness of the toner layer on the sleeve 2 is smaller than the minimum clearance between the photosensitive member 6 and the sleeve 2 in the developing zone A.

The sleeve 21 is supplied with an AC voltage or a superposed AC and DC voltage from a bias voltage source 7. By this, a vibrating electric field in which the direction is alternatingly and repeatedly reversed is formed in the developing zone A. The toner makes, vibrating motion by the vibrating electric field so as to develop the electrostatic latent image formed on the photosensitive member 6. The AC component of the bias voltage may be in the form of a sine wave, a rectangular wave, a saw teeth wave or the like (U.S. Pat. Nos. 4,292,387 and 4,395,476). The minimum clearance between the sleeve 2 and the photosensitive member 6 is preferably not more than 1 mm.

The toner remaining on the sleeve 2 having passed through the developing zone A is collected back into the container 1.

Figure 2:
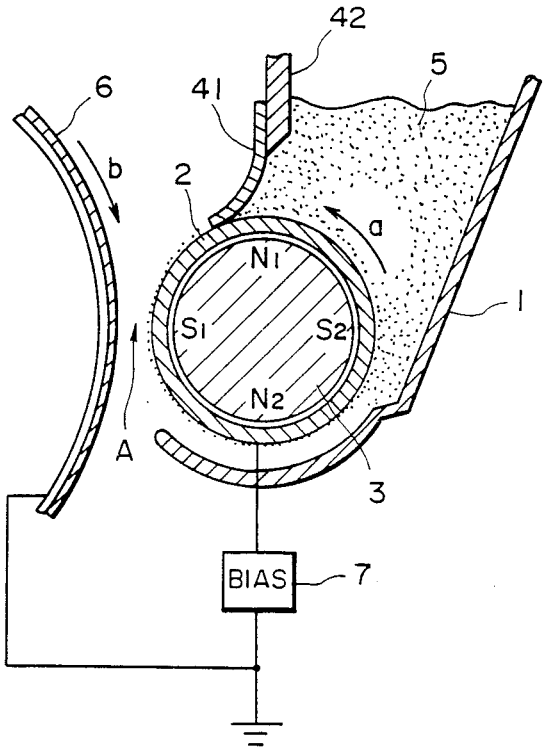
FIG. 2 is a sectional view of a developing apparatus according to another embodiment of the present invention.

In the apparatus of FIG. 2, an elastic blade 41 having a surface press-contacted to the sleeve 2 is used in place of the magnetic blade 4 of FIG. 1. A thin layer of the toner is formed on the sleeve 2 by the toner passing through the press-contact portion or nip between the elastic blade 41 and the sleeve 2. The thickness of the toner layer is smaller than the minimum clearance between the photosensitive member 6 and the sleeve 2 in the developing zone A. As for the material of the blade 41, it may be rubber such as urethane rubber and silicone rubber or a metal plate spring such as phosphor bronze plate and stainless steel plate, or the like.

In FIG. 2, the blade 41 is so disposed that the position of the press-contact to the sleeve 2 is disposed downstream of the fixed position thereof to a fixing member 42, with respect to the rotational direction of the sleeve. However, the position of the press-contact may be upstream of the fixing position.

The apparatus of FIG. 2 is usable with the toner 5 which may be magnetic or non-magnetic. When the toner 5 is non-magnetic, the magnet 3 is not needed.

Figure 3A:
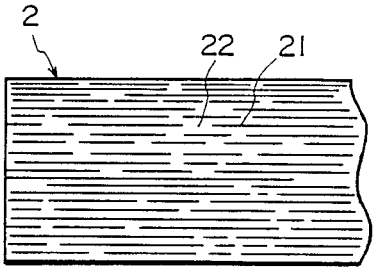
FIG. 3A shows an outer appearance of a sleeve.
Figure 3B:
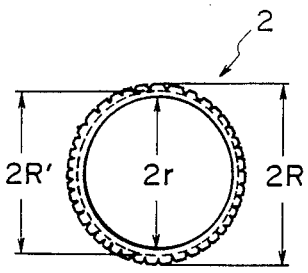
FIG. 3B is a sectional view of a sleeve.
Figure 3C:
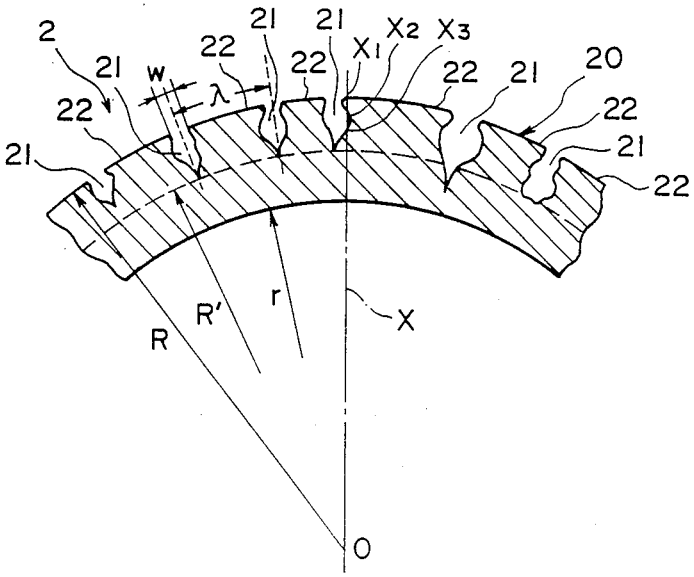
FIG. 3C is an enlarged sectional view of a part of the sleeve.

As shown in FIG. 3B and 3C, the cross-section of the sleeve 2 is cylindrical having an outer diameter of 2R and an inner diameter 2R. As shown in FIG. 3C, the outer peripheral surface 20 of the sleeve 2 is a roughened surface having a very great number of fine concavities which are concave radially internally from the outer surface 20 thereof and smooth and curved surfaces 22 distributed randomly to define the outer diameter 2R. Substantially at each of the concavities 21, the inner surface defining the concavity 21 is crossed with a radial line X extending from the center 0 of the sleeve 2 toward the outer peripheral surface 20 at not less than three points (X1, X2 and X3).

In FIGS. 3B and 3C, a diameter 2R′ is an average diameter of the bottom ends of the concavities 21 formed on the outer surface of the sleeve. The bottom of the concavity 21 may be sharp or flat.

As shown in FIG. 3A, the concavities 21 and flat portions 22 are extended in the form of stripes in the longitudinal direction of the sleeve, that is, in the direction of the rotational axis.

The surface roughness of the outer surface of the sleeve 2 provided by the concavities 21 is preferably 0.1–10 microns on the basis of JIS (Japanese Industrial Standard) ten point average roughness (Rz), further preferably 0.2–8 microns. As shown in FIG. 3C, an average pitch (λ) between concavities measured on the basis of the centers of the concavities is preferably 1–1000 microns, and further preferably 5–700 microns, although it depends on the toner used and the developing system employed. The width (w) of the concavities 21 on the outer peripheral surface 20 of the sleeve is preferably 0.1–50 microns on the average, and the proper width is determined in consideration of the toner particle size or the like by one ordinary skilled in the art.

The sleeve 2 can be manufactured in the following manner. The sleeve 2 can be manufactured by a usual drawing and ironing method. However, a step is added to roughen the surface of a blank cylinder (blank roller) formed by the drawing process, prior to the ironing process, or to roughen the surface of the blank cylinder prior to the final ironing process of plural ironing processes.

Figure 7:
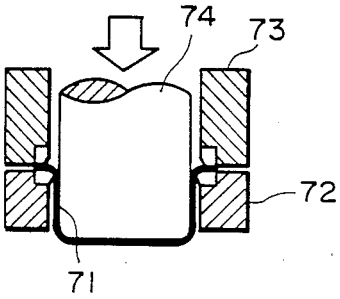
FIG. 7 illustrates a drawing step.

In the drawing process shown in FIG. 7, a plate made of aluminum alloy containing a small amount of silica, iron and manganese or the like with fixed to a die 72 having a circular opening by a supporting member 73. The plate is drawn through the opening of the die 72 by pushing it by a punch 74 to form a blank cylinder 71 in the form of a cup.

Figure 8:
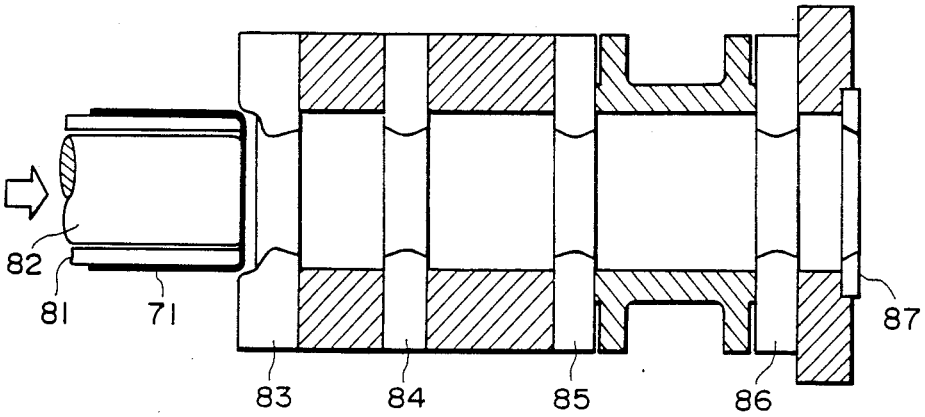
FIG. 8 illustrates an ironing step.

In the ironing process shown in FIG. 8, the blank cylinder 71 is supported by a supporting member 81 and is pushed in the direction of the arrow by a punch 82. Reference numerals 83, 84, 85 and 86 designate a redrawing die, a first ironing die, a second ironing die and a third ironing die. The dice 83, 84, 85 and 86 have circular openings having diameters decreasing in this order. The blank cylinder 71 is urged by the punch 82 to be passed through the dice, during which the outer periphery is ironed thereby by which the diameter thereof is decreased gradually. Designated by a reference numeral 87 is a stripper.

Figure 4:
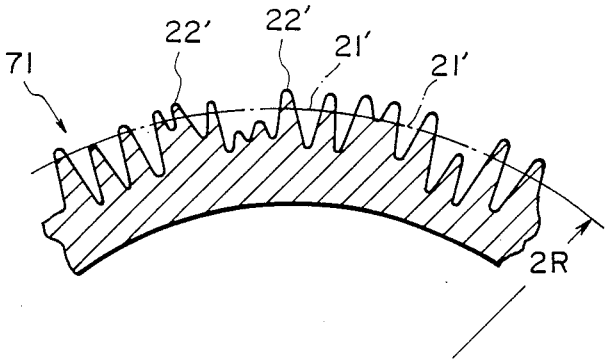
FIG. 4 is an enlarged sectional view of a part of a blank sleeve having been roughened.

After the drawing process of FIG. 7 and before the ironing process of FIG. 8, the outer peripheral surface of the blank cylinder is roughened. Otherwise, referring to FIG. 8, the first ironing process is performed with the die 86 omitted, and the second blank cylinder is formed by a blank cylinder 71, and then, the outer peripheral surface of the second blank cylinder is roughened, and subsequently, the second blank cylinder having been roughened is subjected to the second ironing process with only die 86 used without the dice 83, 84 and 85, in FIG. 8. The surface roughening process of the outer periphery of the blank cylinder is performed in the manner shown in FIG. 9, in which a dish having an arcuated cross-section has sandpaper 76 bonded thereto. The sandpaper 76 is pushed against the blank cylinder 71, and the dish 75 is linearly moved in the direction D1, that is, in the longitudinal direction of the cylinder 71, and when the dish 75 is moved from a longitudinal end of the cylinder and reaches the other longitudinal end, the cylinder is rotated through a predetermined angle in the direction D2. This is repeated to form on the outer peripheral surface of the cylinder 71 a great number of fine projections 22' extending in the longitudinal direction of the cylinder, as shown in FIG. 4. By the projections 22', a great number of fine grooves 21' extending in the longitudinal direction is formed. The depth and width of the grooves 21' are determined by the particle size of the sandpaper used for the roughening process. The projections 22' are collapsed through the subsequent ironing process with the dice to provide a final outer diameter 2R. As shown in FIG. 3C, fine smooth surfaces 22 are formed, and the grooves are deformed, by which concavities having a complicated structure is formed.

The maximum ironing rate in the ironing process is limited by the material used. For example, when the material of the sleeve is aluminum, the limit ironing rate is approximately 40%. However, if the mechanical accuracy and the fine structure of the surface are as described above according to the present invention, the sleeve can be processed beyond the theoretical ironing rate limit.

If, on the other hand, the blank cylinder is passed through a die having the diameter which is the same as that of the blank cylinder, the theoretical ironing rate is zero, but actually, the sleeve surface is in contact with the die, and therefore, the projections on the surface formed by the preceding surface roughening process are collapsed to provide a smooth surface 22, and therefore, a certain effect are provided.

In an embodiment of the present invention, the dice are determined so that a final outer diameter becomes 20.0 mm from a pipe of an aluminum alloy (A3003) having an inner diameter of 18.5 mm and an outer diameter of 20.5 mm after the longitudinal surface roughening process with sandpaper of #400. After the final ironing process, the pipe is cut into desired lengths, and then they are rinsed to provide the sleeve. In this case, the final sleeve is made with the ironing rate of 25%.

Figure 5:
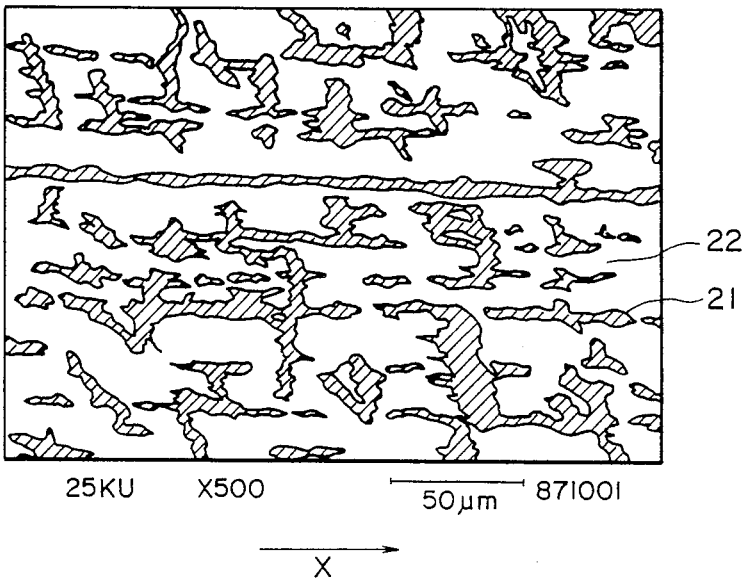
FIG. 5 is a drawing of a photograph of the surface of the sleeve by an electron microscope.

FIG. 5 shows a picture obtained by a scanning type electronic microscope (JSM-T220, available from Nippon Denshi Kabushiki Kaisha, Japan), of a surface of the sleeve manufactured in the manner described above. As will be understood from this figure, there are microscopic smooth flat portions 22 and concavities 21. The concavities 21 in the form of grooves are present over the entire longitudinal area. In addition, it is understood that the concavities 21 are scattered randomly on the surface.

FIG. 5 is a drawing of a picture in the scale of 500 taken at an angle of 45 degrees relative to the sleeve surface. By the observation with further inclination, it has been found that the internal surfaces of the concavities 21 are complicated by being gouged, as shown in FIG. 3C.

The ten point average surface roughness of the sleeve (Rz) on the basis of JIS D 0601 was 0.8 micron in the circumferential direction of the sleeve and was 4.0 microns in the direction of the rotational axis of the sleeve.

Figure 6A:
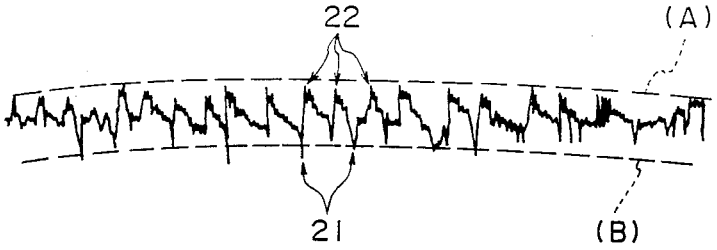
FIGS. 6A and 6B are waves of the sleeve surface measured by a surface roughness tester.
Figure 6B:
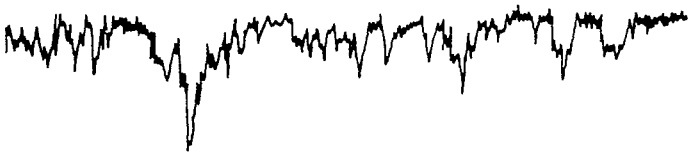

The surface roughness measured by a fine roughness sensor (available from Kabushiki Kaisha Kosaka Kenkyuso, Japan or from Tailer Bobson) is shown in FIGS. 6A and 6B. FIG. 6A represents the surface roughness in the circumferential direction of the sleeve, and FIG. 6B represents the surface roughness in the longitudinal direction of the sleeve.

In FIG. 6A, the broken line A is an envelope of the upper peaks, whereas the broken line B represents an envelope of the bottom peaks. As will be understood from this Figure, the broken line constituting the outer peripheral surface of the sleeve is provided by fine flat surface portions 22 newly provided by the projections on the surface treated by the sandpaper being subjected to the ironing process with the final die, and the concavities (and the flat portions) are formed at substantially uniform pitches.

A developing apparatus shown in FIG. 1 was manufactured with the use of the above-described sleeve 2, and experiments were performed to investigate the effects of the present invention. And, the results of experiments will be described.

In the developing apparatus having the structure of FIG. 4, the sleeve was made of aluminum alloy (A3003) and had an outer diameter of 20 mm and an interdiameter of 18.5 mm, and contained a magnet roller 3. The magnet roller 3 had a magnetic pole N1 of 900 Gausses, a magnetic pole N2 of 600 Gausses, an S1 pole of 800 Gausses and a pole of S2 polarity of 700 Gausses. As for the developer regulating blade 4, a steel plate (magnetic) having a thickness of 1 mm was electrically plated, and it was used for the blade 4. The clearance between the blade 4 and the sleeve 2 was 250 microns. The bias voltage source 7 was a combination of an AC voltage and a DC voltage. The AC voltage component had a peak-to-peak voltage Vpp of 1200 V and a frequency F of 1500 Hz, and the DC voltage component had −350 V.

The developer 5 was a one component insulating magnetic toner.

The toner particles contained 55 parts by weight of polystyrene resin, 40 parts by weight of magnetite and 5 parts by weight of carbon black and had an average particle size of 12 microns. An electrification agent was added to the toner powder. It was confirmed that a uniform application of the toner powder on the sleeve 2 was provided with good developing performance.

Various experiments have revealed that if the average pitch λ of the concavities 21 shown in FIG. 3C exceeds 1000 microns, the portion of the flat smooth surface increases with the result that the sleeve surface becomes closer to a mirror surface, and therefore, the toner conveying performance decreases. This results in reduction of the image density. In addition, the toner application on the sleeve 2 becomes non-uniform with the result of deteriorated quality of the image.

If, on the other hand, the pitch λ is smaller than 1 micron on the average, the sleeve surface is again similar to a mirror surface with the result of the similar problems, i.e., the reduction of the image density and non-uniform toner application on the sleeve. Therefore, the pitch λ on the average is preferably 1–100 microns, and further preferably 5–700 microns with remarkable effect of the present invention.

When the surface roughness Rz is smaller than 0.1 micron, the sleeve surface is equivalent to a mirror surface, and the same problems as with the longer pitch λ results, and therefore, it is not practically preferable. If, on the other hand, the surface roughness is larger than 10 microns, the pitch λ correspondingly increases. Then, the toner conveying performance is improved, but simultaneously therewith, the toner is more easily used on the sleeve to an impractical extent. Therefore, the surface roughness Rz is preferable 0.1–10 microns, further preferably 0.2–8 microns with the remarkable effect of the present invention.

In the sleeve 2 of the present invention, the sharp projections provided by the process of roughening the blank cylinder are collapsed by the ironing process so that the surface shown in FIG. 3C is formed. Therefore, even with a long period use, the possible change in the fundamental surface configuration due to wear with use can be constrained. For this reason, the reduction of the toner conveying power and the toner charging power is minimized in long term use, and in addition, the uniformity of the toner layer is maintained.

When a developing apparatus having the structure described above was actually operated to process 10,000 sheets with ambient conditions extending from low temperature and low humidity conditions (15° C., 10%) to high temperature and high humidity conditions (32.5° C., 90%). It was confirmed that the density change of the developed image was small, that the background was not foggy, that the toner was not scattered, that the toner component was not fused to the sleeve and that the good conditions were maintained.

The same resulted with the apparatus having the structure of FIG. 2.

Figure 10:
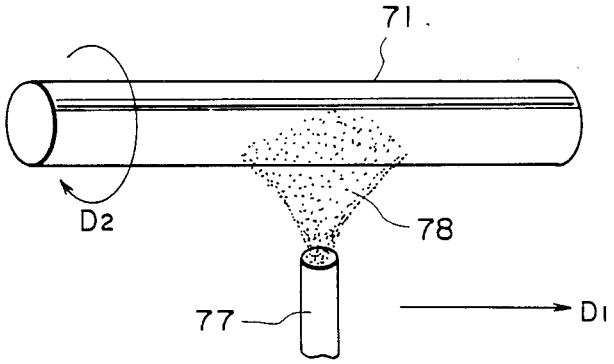
FIG. 10 illustrates a surface roughing step by sandblasting.

The surface roughening process of the blank cylinder 71 may be performed by sandblasting shown in FIG. 10. In FIG. 10, blast particles (spherical particles or irregular particles having plural sharp edges and having non-uniform shapes, or a mixture of the spherical particles and irregular particles) are blasted with high pressure air from a nozzle 77 to the blank cylinder 71. The cylinder 71 rotates in the direction D2, and simultaneously, the nozzle 77 moves in the direction D1. The blank cylinder thus sandblasted is ironed through a die so that fine projections on the surface of the cylinder are collapsed.

The description will be made as to extruding and drawing method for manufacturing the sleeve 2.

Figure 11:
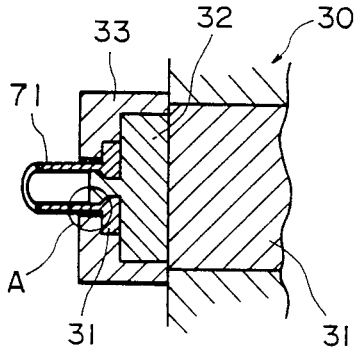
FIG. 11 illustrates an extruding process.
Figure 12:
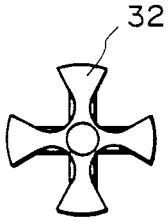
FIG. 12 is a front view of a plug used in the process in FIG. 11.
Figure 13:
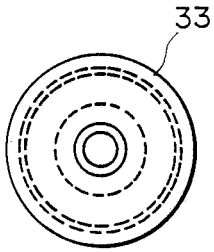
FIG. 13 is a front view of a die used in FIG. 11 process.

Referring to FIG. 11 showing an extruder 30, a sleeve material 31 made of aluminum alloy cast (A3003) is pushed leftwardly through a plug 32 shown in FIG. 12 in a front view and a extruding die 33 shown in FIG. 13 in a front view, so that a blank cylinder 71 is formed.

Figure 14:
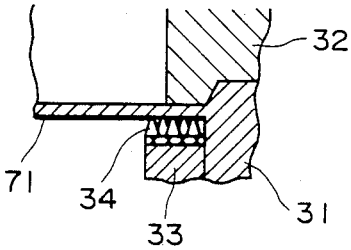
FIG. 14 is an enlarged view of "A" part of FIG. 11.
Figure 15:
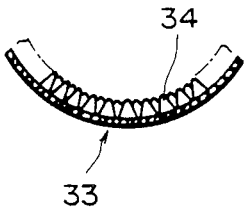
FIG. 15 is an enlarged view of a part of the die of FIG. 13.
Figure 18:
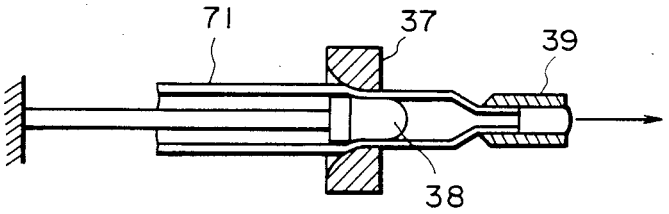
FIG. 18 illustrates a drawing process.

As shown in FIGS. 14 and 15, the inside wall 34 of the extruding die 33 has regular or irregular projections and concavities having a maximum depth of 0.1 mm. Therefore, the outer peripheral surface of the blank cylinder 71 extruded is provided with a fine groove and fine projections extending in the longitudinal direction. Then, as shown in FIG. 18, the blank cylinder 71 is drawn through a die 37 having an inside wall surface having a smooth circular surface. In FIG. 18, a plug 38 is effective to define the inside diameter of the sleeve, and a supporting tool 39 for gripping and drawing the cylinder is shown.

For example, the blank cylinder 71 is extruded by the extruder shown in FIG. 11 so that it has an outer diameter of 20.5 mm and an inner diameter of 18.5 mm. By the subsequent drawing process, the outer diameter becomes 20.0 mm. The surface of the blank cylinder produced in this manner is provided with a number of longitudinal grooves due to the extruding process. The projections on the outer surface thus formed are collapsed by the subsequent drawing step to provide a predetermined outer diameter shown in FIG. 3C. As a result, fine flat smooth surface portions 22 and concavities 21 in the form of grooves extending in the longitudinal direction and having proper depth are provided.

The sleeve 2 produced in this manner was incorporated in the developing apparatus shown in FIG. 1 or 2 and was operated. It was confirmed that the resultant image was good, and that the initial good quality of the images could be maintained even after long term use.

Figure 16:
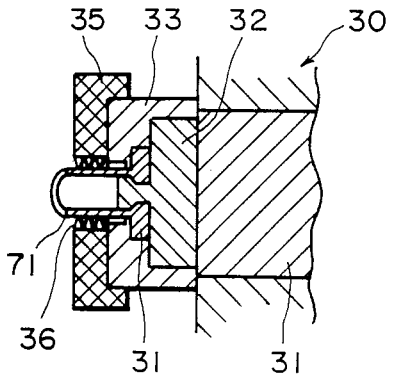
FIG. 16 illustrates another extruding process.

As shown in FIG. 16, it is possible that a tool 35 for forming the longitudinal grooves on the outer peripheral surface of the blank cylinder is mounted to a neighborhood of an outlet of the die 33 of the extruder 30, so that the longitudinal groove formation is continued from the extruding process. The groove formation process may be performed on the blank cylinder after the extruding process, more particularly after the blank cylinder is dismounted from the extruder, with the same advantageous effects.

Figure 17:
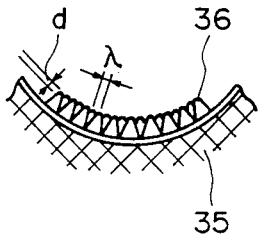
FIG. 17 is an enlarged view of a part of a tool 35 used with the process illustrated in FIG. 16.

The groove formation tool has a number of projections 36 on the inner surface along which the blank cylinder passes. As an example, as shown in FIG. 17, good results are obtained by use of such a tool that the pitch λ of the most closely adjacent projections 36 is 200 microns, that the depth of the groove finally formed on the blank cylinder surface after the projections 36 are interfered is 100 microns and that a diameter defined by the peaks of the projections 36 is 20.2 mm.

On the surface of the blank cylinder 71 having passed through the groove forming tool 35 is provided with fine grooves. The blank cylinder is drawn by the apparatus shown in FIG. 18 so as to provide the outside diameter of 20.0 mm and the inside diameter of 18.5 mm, by which a desired sleeve is manufactured. The surface of the sleeve produced in the manner described above has the surface similar to those of the foregoing embodiments. This is incorporated in the developing apparatus of FIG. 1 or 2, and it has been confirmed that the image density is proper, that the image quality is good and that the good image quality equivalent to the initial quality can be maintained even after long term use.

In FIG. 16, the die 33 is different from the die 33 of FIG. 11 in that the inside wall surface of the circular opening is smooth. In FIG. 16, it is possible that the tool 35 is omitted, and the blank cylinder produced by the extruder is subjected to the surface roughening process described in conjunction with FIG. 9 or 10.

Figure 9:
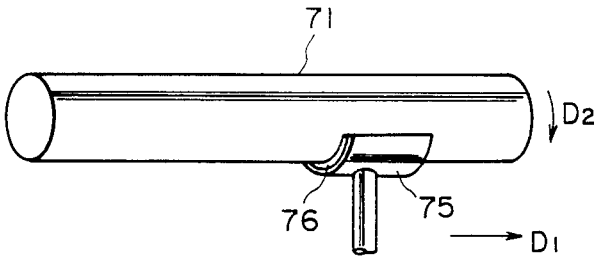
FIG. 9 illustrates surface roughing step by sandpaper.

An example will be described wherein the blank cylinder 71 produced by the extruder of FIG. 16 without the tool 35 is subjected to a surface roughening process by the sandpaper shown in FIG. 9 and then, the cylinder 71 is drawn as shown in FIG. 18, and wherein the sleeve thus produced is incorporated in the developing apparatus of FIG. 1.

Example 1: The blank cylinder was roughened by sandpaper #400 in the longitudinal direction of the sleeve, and it was drawn at ironing rate of 0%:

Example 2: The blank cylinder was roughened by sandpaper #400 in the longitudinal direction of the sleeve, and it was drawn with an ironing rate of 25%:

Example 3: The blank cylinder was roughened by sandpaper #400 in the longitudinal direction of the sleeve, and it was drawn with an ironing rate of 35%.

Those examples use the present invention.

As Comparison Examples, the following examples were taken:

Example 4: The blank cylinder was machined; it was roughened by sandpaper #400, without ironing process:

Example 5: The blank cylinder was machined and abraded.

The cylinder of Example 4 has the surface as shown in FIG. 4. The cylinder of Example 5 has a mirror surface.

The results of experiments for the respective sleeves were as follows:

EXAMPLE 1

The good initial image quality can be maintained until 1500 sheets were processed, but after 4000 sheets, the image density decreased, and the resolution of the image was slightly deteriorated.

EXAMPLE 2

The good initial image quality can be maintained even after 10,000 sheets were processed.

EXAMPLE 3

The good initial image quality could be maintained even after 10,000 sheets were processed.

EXAMPLE 4

At the beginning, the image density was high, and the image resolution was good, but the background became foggy, and the image resolution was deteriorated, despite the high image density, after 1500 sheets were processed.

EXAMPLE 5

From the beginning, the toner coating on the sleeve was non-uniform due to non-uniform charging of the toner, with the result of non-uniform image density, and the image density was low.

The following is a table summarizing the results of experiments.

| | No. of processed sheets | | | |
|---|---|---|---|---|
| No. | INITIAL | 1500 | 4000 | 10000 |
| 1 | G | G | F | F |
| 2 | G | G | G | G |
| 3 | G | G | G | G |
| 4 | G | F | F | F |
| 5 | N | — | — | — |

G: Image density is high. The toner is not scattered The background is not foggy. The resolution of the image is good.
F: The image density is slightly low, or the image resolution is slightly deteriorated, but is practically usable.
N: The image density is extremely low, the toner is scattered, the background is foggy, or the image is not uniform, and therefore, it is not practical.

The same results were obtained when the sleeves of Examples 1–5 were incorporated in the developing apparatus of FIG. 2.

It is possible that the blank cylinder is produced by the apparatus of FIG. 16 without the tool 35; then, the outer surface of the blank cylinder is subjected to the sandblasting process shown in FIG. 10; and then, the blank cylinder is drawn as shown in FIG. 18, so that the sleeve is produced. In this case, the blank cylinder is produced from an aluminum alloy described in the foregoing, for example, into a cylinder having an outer diameter of 20.5 mm. The blank cylinder is subjected to blasting treatment with blast particles #400, and thereafter, it is passed through a die by a drawing apparatus so that the cylinder has a final outer diameter of 20.0 mm and an inside diameter of 18.5 mm, as the sleeve.

The blank cylinder is cut into the length of 317.0 mm, and the longitudinal ends are deburred. Thereafter, flanges are bonded to the longitudinal ends. After the inspection step, the sleeve for the developing apparatus is produced.

According to this embodiment, the surface of the blank cylinder roughened by the blast treatment has a number of projections, but the projections are collapsed by the subsequent drawing step wherein the cylinder is passed through a die, so that the outer diameter is regulated to a predetermined diameter. In addition, the collapsed projections provides fundamentally discontinuous fine flat surface portions 22. In cross section of the sleeve, the concavities 21 have complicated configuration as shown in FIG. 3C. The number of the fine flat surface portions 22 are determined in association with the number of projections, and the area of the smooth surface portions 22 is dependent on the ironing rate.

It has been found that a great number of stripes are formed by passing the drawing die, the stripes extending in the longitudinal direction of the sleeve. The sleeve produced in the manner described above was incorporated in the developing apparatus of FIGS. 1 and 2. In this embodiment, similarly to the foregoing embodiment, the application of the toner on the sleeve was good, and the good quality of the developed image which is the same as in the initial stage were provided even after long term use. In addition, the toner fusing was not observed on the sleeve.

FIG. 18 illustrates plug drawing, but another method such as hollow sinking, floating plug drawing and rod drawing methods, are usable.

In the foregoing embodiments machining, abrading for determining the dimensional accuracy is not required prior to the roughening process for the blank cylinder, and therefore, the manufacturing cost of the sleeve can be reduced, and the manufacturing efficiency is improved.

In FIGS. 1 and 2, the sleeve is supplied with a bias voltage having an AC component, but it is a possible alternative that the power source 7 is a DC source so that a DC voltage not containing the AC component can be applied to the sleeve 2 as the bias voltage.

When the toner used is a capsuled toner (one component developer) which is more easily deteriorated and which is more easily fused to the developing roller, the present invention is effective to reduce those inconveniences. From this standpoint, the present invention is particularly suitable for the developing apparatus using the capsuled toner.

In all of the embodiments described above, the developing apparatus uses one component developer, but the present invention is applicable to a developing apparatus using two component developer containing magnetic carrier particles and non-magnetic toner particles.

For example, the two component developer contains no-magnetic toner particles having an average particle size of 5–15 microns and magnetic carrier particles having an average particle size of 30–100 microns, preferably 40–80 microns, having a resistivity of not less than $10^7$ ohm.cm, preferably not less than $10^8$ ohm.cm, and made of ferrite particles (maximum magnetization of 60 emu/g) coated with resin material. In the developing apparatus using the two component developer, the roughness of the sleeve surface can be increased since the conveying property of the sleeve 2 is more concerned with the carrier particles and the carrier particles have a diameter which is usually not less than 5 times that of the one component developer, approximately.

The experiments and investigations by the inventors have revealed that the carrier conveying power is good when the average pitch (λ) of the sleeve concavities 21 is 1–2.5 mm, and with the pitch, the image has good image density and does not have nonuniformness. If the pitch λ is not more than 1 micron and not less than 2.5 mm, the carrier conveying power is not good, and the image density is not high and not uniform, and therefore, not preferable.

As described in the foregoing, according to the present invention, the surface of the developing roller is roughened to become provided with fine projections and concavities, and the top parts of the projections were collapsed by the subsequent ironing and drawing process to become provided also with flat surface portions. With this structure, the change of the surface condition or state of the roller surface due to wearing is small even with long term use, and therefore, the change in the developer conveying power is small. Therefore, a uniform thin layer of the developer can be formed for a long period of time, and in addition, the deterioration of the developer layer and the toner fusing on the roller can be prevented. By the collapse of the top parts of the projections, visors are formed, by which the developer conveying force is increased with the advantage of loosening the developer powder, thus further increasing the uniformity of the developer layer. Also, the triboelectric charge on the developer particles becomes proper.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image, comprising:

a container for containing a developer; and a rotatable developing roller for carrying the developer supplied from said developer container into a developing zone where the electrostatic latent image is developed, said developing roller having a developer carrying surface having fine concavities and having finely smooth surface portions formed by a process selected from the group consisting of ironing and drawing.

2. An apparatus according to claim 1, wherein said developing roller is made of aluminum alloy.

3. A developing apparatus according to claim 1 or 2, further comprising a regulating member for regulating a thickness of the developer layer to be carried to the developing zone to be smaller than a minimum clearance between the developing roller and the electrostatic latent image bearing member in the developing zone.

4. An apparatus according to claim 3, further comprising a power source for applying to said developing roller a voltage containing an AC component.

5. An apparatus according to claim 3, further comprising a power source for applying to said developing roller a DC voltage.

6. A developing apparatus for developing an electrostatic latent image, comprising:

a container for containing a developer; and a rotatable developing roller for carrying the developer supplied from said developer container into a developing zone where the electrostatic latent image is developed;

said developing roller having a developer carrying surface having finely smooth surface portions and fine concavities, wherein each of said concavities has an opening smaller than a size of an interior portion thereof.

7. A developing apparatus according to claim 6, further comprising a regulating member for regulating a thickness of the developer layer to be carried to the developing zone to be smaller than a minimum clearance between the developing roller and the electrostatic latent image bearing member in the developing zone.

8. An apparatus according to claim 7, further comprising a power source for applying to said developing roller a voltage containing an AC component.

9. An apparatus according to claim 7, further comprising a power source for applying to said developing roller a DC voltage.

* * * * *

UNITED STATES PATENT AND TRADEMARK OFFICE

CERTIFICATE OF CORRECTION

PATENT NO. : 4,982,689

DATED : January 8, 1991

INVENTOR(S) : MITSURU HONDA, ET AL.

It is certified that error appears in the above-identified patent and that said Letters Patent is hereby corrected as shown below:

COLUMN 1

Line 39, "that" should read --in that--.
Line 49, "conditions" should read --condition--.
Line 53, "result" should read --results--.
Line 62, "caused" should read --are caused--.

COLUMN 3

Line 27, "makes," should read --makes a--.

COLUMN 4

Line 37, "with" should read --is--.

COLUMN 6

Line 21, "interdiame-" should read --inner diame- --.

COLUMN 7

Line 2, "preferable" should read --preferably--.
Line 12, "power" (both occurrences) should read --powder--.

UNITED STATES PATENT AND TRADEMARK OFFICE

CERTIFICATE OF CORRECTION

PATENT NO. : 4,982,689

DATED : January 8, 1991

INVENTOR(S) : MITSURU HONDA, ET AL.

It is certified that error appears in the above-identified patent and that said Letters Patent is hereby corrected as shown below:

COLUMN 10

Line 55, "no-magnetic" should read --non-magnetic--.

Signed and Sealed this

Eleventh Day of August, 1992

*Attest:*

DOUGLAS B. COMER

*Attesting Officer*

*Acting Commissioner of Patents and Trademarks*